US005183264A

United States Patent [19]

Lanctot

[11] Patent Number: 5,183,264

[45] Date of Patent: Feb. 2, 1993

[54] HOCKEY STICK

[76] Inventor: Paul A. Lanctot, 520 Sand Hill Rd., Scotts Valley, Calif. 95066

[21] Appl. No.: 865,177

[22] Filed: Apr. 9, 1992

[51] Int. Cl.[5] ..... A63B 59/12

[52] U.S. Cl. ..... 273/67 A; 273/81 A

[58] Field of Search ..... 273/73, 67, 72, 170, 273/80 R, 80 A, 80 B, 80.4, 80.8, 81 A

[56] References Cited

U.S. PATENT DOCUMENTS

| | | | |
|---|---|---|---|
| 879,477 | 2/1908 | Kruger | 273/67 A |
| 4,182,512 | 1/1980 | Kuebler | 273/73 C |
| 4,330,125 | 5/1982 | Sassler | 273/73 C |
| 4,541,631 | 9/1985 | Sasse | 273/170 |

FOREIGN PATENT DOCUMENTS

| | | | |
|---|---|---|---|
| 329964 | 2/1933 | Canada | 273/67 A |
| 2106800 | 9/1971 | Fed. Rep. of Germany | 273/73 J |
| 8501591 | 1/1987 | Netherlands | 273/67 A |
| 1121051 | 7/1968 | United Kingdom | 273/67 A |

*Primary Examiner*—Mark Graham
*Attorney, Agent, or Firm*—Jeffrey A. Hall

[57] ABSTRACT

A hockey stick (10) having a stick portion (12) and a blade (13). A tubular member (14) is positioned in the interior of the hockey stick (10) at substantially the center of the stick portion (12) and has a first end (24) and a second end (25), the first end (24) having an openign (28) therein which is removably sealed with a plug (17). A hollow spine member (16) is secured within the tubular member (14) and is preferably attached to the plug (17) and to the second end (25) of the tube member (14). A slurry (15) composed of a plurality of particles (26) and a fluid (27) is disposed within the tubular member (14). The tubular member (14) may be secured witin the hockey stick by adhesives (30) or by mechanical fastening apparatus.

18 Claims, 2 Drawing Sheets

HOCKEY STICK

BACKGROUND OF THE INVENTION

1. Field of Invention

This invention relates to hockey sticks, particularly to hockey sticks having means to dampen and isolate shock components generated as a result of the impact when the hockey stick blade strikes a puck or a ball.

2. Description of Prior Art

Hockey sticks, baseball bats, racquets, paddles and golf clubs are all commonly used in various sports where the object is to strike a moving or stationary ball or puck in order to propel it some distance. These implements have certain problems in common as well as common objectives. A primary problem is the generation of a shock as a result of the impact of the ball with the stick, bat, racquet, club, etc. A primary objective is superior performance and feel of the implement.

In a hockey stick the shock generated is most severe when the puck or ball impacts a point other than the optimum striking point or "sweet spot" on the hockey stick blade. The "sweet spot" is the point where the most impact energy will be delivered to the puck or ball and the hockey stick rebounds straight back and opposite to the ball's line of flight, and without torquing, end for end, as rotation is developed. When this point is missed, some of the impact energy is delivered to the stick, off center, causing the stick to rotate, end for end, which results in both uncomfortable and injurious levels of shock being transmitted through the stick to the athlete. At best, this painful shock can rob the athlete of confidence, and at worst, it can cause serious injury, while detracting from performance and feel of the hockey stick.

It would be highly desirable therefore to provide a means and method to specifically reduce the destructive shock generated by a hockey stick after striking a puck or ball while leaving the puck or ball propulsion function of the hockey stick essentially unchanged, while increasing hockey stick speed, and enhancing the performance and feel of the hockey stick.

SUMMARY OF THE INVENTION

A hockey stick comprising a stick portion and a blade. A tubular member is affixed within said stick portion of said hockey stick. The tubular member has a first end and a second end, said first end having an opening therein which is preferably sealed with a removable plug, said second end is preferably closed. A plurality of particles are interiorly disposed within said tubular member and surrounded by a fluid which is also interiorly situated within said tubular member. An elongated spine member is secured within said tubular member and is preferably centrally affixed to the center of the closed end of the tubular member.

The tubular member is preferably rectangular in shape and may be composed of plastic, metal, rubber, urethane or the like.

The spine member is preferably composed of a soft compliant material which may be a fabric, plastic, rubber, urethane, or the like, so as to readily transfer shock to said particles and said fluid.

The particles may be of any shape, e.g., granular, flakes, particulate, etc., and may be composed of a metal, plastic, composite, or the like. The particles are combined in the tubular member with a viscous fluid, such as oil, and dampen shock components generated when the hockey stick blade strikes a puck or a ball.

The present invention, by providing a hockey stick having a tubular member having an elongated spine extending therethrough, and having a slurry of particles and fluid therein, said tubular member being securely situated in the stick portion of the hockey stick, reacts specifically to high amplitude shocks delivered at the stick portion of the hockey stick and to any shock acting perpendicular to the stick portion. This device does not adversely affect the propulsion of the puck or ball and improves both the performance and the feel of the hockey stick.

Other advantages and a fuller understanding of the invention will be had by referring to the following description and claims of a preferred embodiment thereof taken in conjunction with the accompanying drawings wherein like reference numerals refer to similar parts throughout the several views.

DETAILED DESCRIPTION OF THE PREFERRED EMBODIMENT OF THE INVENTION

Although specific terms are used in the following description for the sake of clarity, these terms are intended only to refer to the particular structure of the invention elected for illustration and are not intended to define or limit the scope of the invention.

Figure 1:
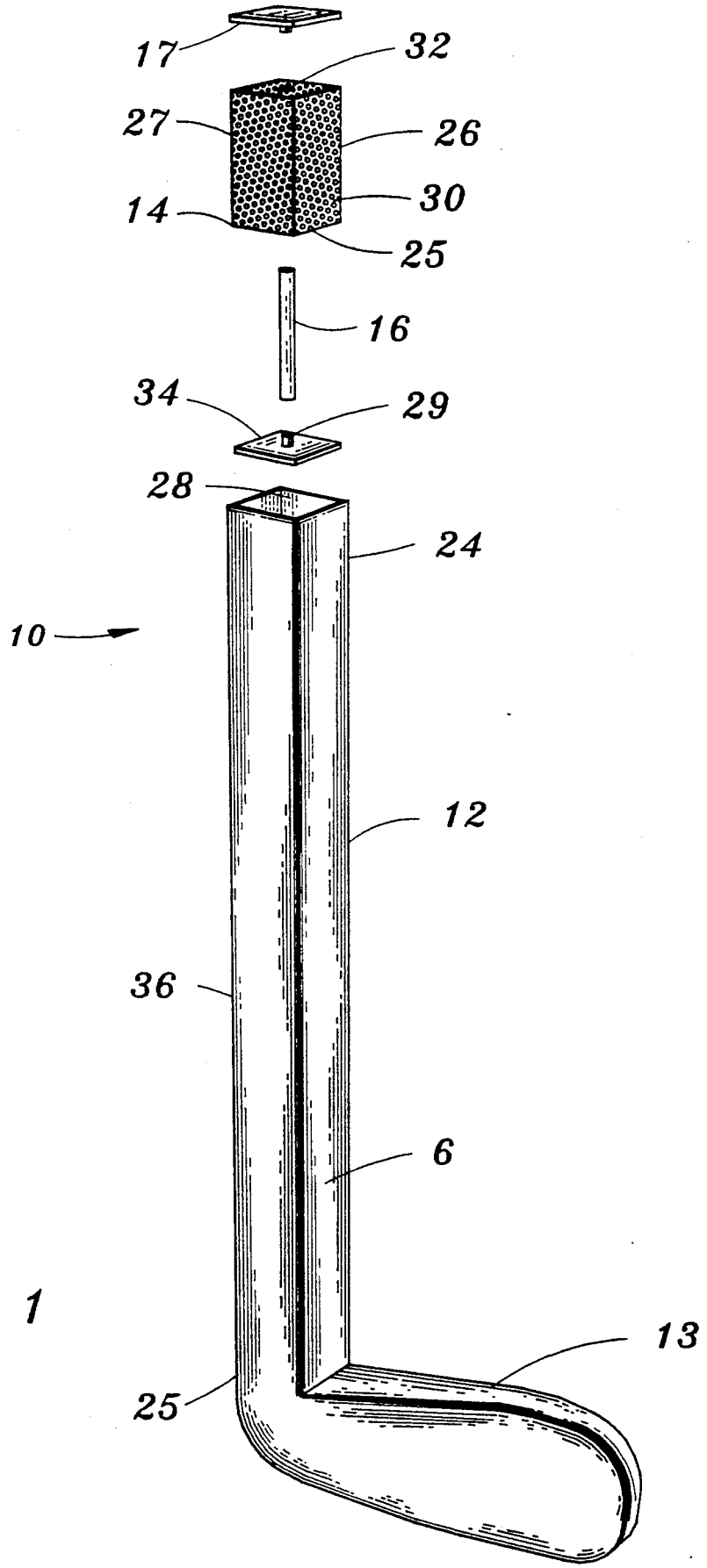
FIG. 1 is a side perspective view of a hockey stick showing the tube, spine, and slurry removed for illustrative purposes, in accordance with the teachings of the present invention.

FIG. 1 shows a hockey stick according to the preferred embodiment of the invention. The hockey stick 10 comprises an elongated stick portion 12 and a blade 13. A tubular member 14 which is preferably rectangular in shape and having a first end 24 having an opening 28, and a second end 25 which is preferably closed, is inserted into said stick portion 12 of hockey stick 10, preferably in substantially a middle portion 36 thereof Tubular member 14 is preferably rigidly secured in stick portion 12 by adhesives 30 and having a cap 34, but may be otherwise. Tubular member 14 preferably is situated in the middle portion 36 of stick 12 for optimal effect. An elongated spine member 16 is secured within tubular member 14. Spine member 16 is preferably centrally secured to said second end 25 of tubular member 14 by adhesives 30 and a compression nipple 29 and centrally to a plug 17 which is used to seal opening 28 of tubular member 14.

Figure 2:
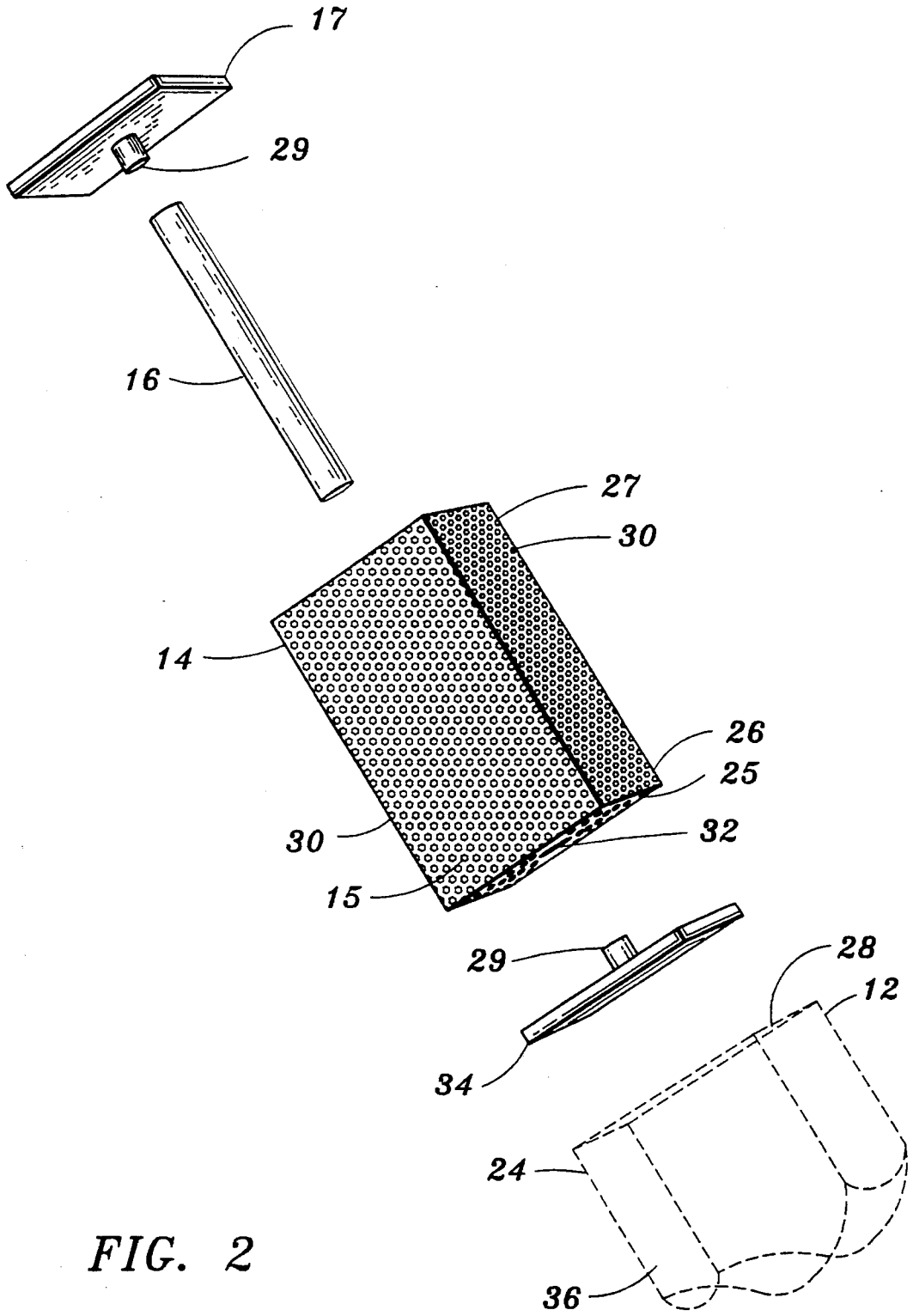
FIG. 2 is an enlarged partial, cross-sectional view corresponding to the tube, spine, and slurry as inserted into the stick portion of such hockey stick, according to the invention.

Referring to FIG. 2 spine 16 is preferably affixed to plug 17 by compression nipple 29 and adhesives 30. Spine 16 is, in the preferred embodiment, hollow, having space 32 therein. Spine 16 may be composed of rubber, plastic, or any compliant material, but is preferably composed of silicone rubber.

Tube 14 is filled with a slurry 15 composed of a plurality of particles 26 combined with a fluid 27. The plurality of particles 26 may be composed of metal, plastic, composites, or the like, or a combination of such materials, with lead shot being a preferred particle type. The fluid is preferably viscous such as oil, but any flowable liquid may be used as well as "jello-like" compositions. As an alternative embodiment, particles 26 and or spine 16 may be eliminated from tube 14, however, this results in some lessening of the dampening and noise reducing effect of the present invention. As FIG. 2 illustrates, the tubular member 14, slurry 15, spine 16, and plug 17 may be easily retro-fitted onto existing hockey sticks or manufactured as part of a new type of hockey stick.

In operation and use, hockey stick 10 is very efficient at dampening shocks produced by inaccurate hits as well as enhancing a wide variety of other functions such as stick speed and enhancing the performance and feel of the hockey stick. It is believed that such advantages are achieved as herein described, however, no limitations on the scope or breadth of the present invention should be implied therefrom.

In application, hockey stick 10 when striking a puck or ball causes the inside of tube 14 to impact with the plurality of particles 26 in slurry 15, and the particles and the fluid transfer of this force is in an essentially random manner since the independent components of the particles careen off of each other and the inner surface of tube 14 This randomization redirects a portion of shock 21 in numerous directions thereby reducing its magnitude in any one direction.

The means and methods herein described for the hockey stick of the present invention may also be installed in any implement subject to torquing shocks, for example, tennis racquets, golf clubs, racquets, carpenter's hammers, and the like. Furthermore, in addition to dampening shock components the present invention increases the speed and performance of the implement.

While the above description contains many specificities, they should not be construed as limitations on the scope of the invention but merely as exemplifications of preferred embodiments thereof. It is understood that the present disclosure has been made only by way of example and that numerous changes in the details of construction may be resorted to without departing from the spirit and scope of the invention. Accordingly the scope of the invention should be determined by the appended claims and their legal equivalents, and not by the examples which have been given.

I claim:

1. A hockey stick comprising:

a blade and a stick portion, a tubular member inserted into said stick portion of said hockey stick, having a first end and a second end, said first end having an opening therein, a spine member secured within said tubular member, a plurality of particles interiorly disposed within said tubular member, a fluid interiorly situated within said tubular member, and means for sealing said opening in said first end of said tubular member.

2. The hockey stick of claim 1 wherein said tubular member is secured within said stick portion by adhesives.

3. The hockey stick of claim 1 wherein said tubular member is composed of metal.

4. The hockey stick of claim 1 wherein said spine member is a hollow tube of silicone rubber.

5. The hockey stick of claim 1 wherein said spine member is composed of plastic.

6. The hockey stick of claim 1 wherein said spine member is centrally secured to said second end of said tubular member by a compression nipple and extends lengthwise through said tubular member.

7. The hockey stick of claim 1 wherein said plurality of particles are composed of metal.

8. The hockey stick of claim 1 wherein said plurality of particles are composed of plastic.

9. The hockey stick of claim 1 wherein said plurality of particles are freely flowable.

10. The hockey stick of claim 1 wherein said fluid is an oil.

11. The hockey stick of claim 1 wherein said means for sealing said opening in said first end of said tubular member comprises a plug.

12. In a hockey stick made of rigid material and having a blade and a stick portion, the improvement comprising a tubular member inserted into said stick portion of said hockey stick having a first end and a second end, said first end having an opening therein, an elongated spine member secured within said tubular member by a compression nipple and extending through said tubular member, a plurality of particles interiorly disposed within said tubular member, a fluid dispersed within said tubular member and in contact with said plurality of particles, and means for sealing said opening in said first end of said tubular member.

13. The hockey stick of claim 12 wherein said tubular member is a cylinder of plastic.

14. The hockey stick of claim 12 wherein said tubular member is secured within said stick portion by adhesives.

15. The hockey stick of claim 12 wherein said spine member is a hollow tube of silicone rubber.

16. The hockey stick of claim 12 wherein said plurality of particles are composed of metal.

17. The hockey stick of claim 12 wherein said fluid is an oil.

18. The hockey stick of claim 12 wherein said means for sealing said opening in said first end of said tubular member comprises a plug.

* * * * *